US007195369B2

(12) United States Patent
Shaw

(10) Patent No.: US 7,195,369 B2
(45) Date of Patent: Mar. 27, 2007

(54) SAFETY LIGHT FOR AQUATIC GARMENTS

(76) Inventor: Terena Shaw, 1478 Champlain Drive, Peterborough (CA) K9L 1N4

( * ) Notice: Subject to any disclaimer, the term of this patent is extended or adjusted under 35 U.S.C. 154(b) by 403 days.

(21) Appl. No.: 10/742,827

(22) Filed: Dec. 23, 2003

(65) Prior Publication Data

US 2004/0150987 A1 Aug. 5, 2004

Related U.S. Application Data

(60) Provisional application No. 60/443,861, filed on Jan. 31, 2003.

(51) Int. Cl.
*F21L 15/08* (2006.01)
*B63C 9/08* (2006.01)

(52) U.S. Cl. ..... 362/108; 362/158; 340/573.6; 441/89

(58) Field of Classification Search ..... 362/158, 362/108; 340/539, 573.6; 441/89, 106; 24/204

See application file for complete search history.

(56) References Cited

U.S. PATENT DOCUMENTS 2,361,414 A * 10/1944 Ramsey ..... 362/108
3,621,501 A * 11/1971 Jordan ..... 441/89
3,981,051 A * 9/1976 Brumlik ..... 24/447
5,330,282 A 7/1994 Rodgers
5,622,422 A * 4/1997 Rodgers ..... 362/158
5,690,413 A * 11/1997 Coughlin ..... 362/108
5,748,080 A * 5/1998 Clay ..... 340/539.26
5,886,635 A * 3/1999 Landa et al. ..... 340/573.6
5,903,212 A 5/1999 Rodgers

* cited by examiner

*Primary Examiner*—Sandra O'Shea
*Assistant Examiner*—James W Cranson, Jr.

(57) ABSTRACT

An aquatic garment carries a safety light and circuit attached to the garment so that it may not be detached without damage. The circuit times an interval in response to change of state of an acceleration switch. The circuit causes the light to light at least once during said interval.

21 Claims, 4 Drawing Sheets

SAFETY LIGHT FOR AQUATIC GARMENTS

Applicant claims priority based on Provisional Application 60/443,861, filed on Jan. 31, 2003.

BACKGROUND OF THE INVENTION

This invention relates to a light and control circuit therefor and to the manner of attaching this to an aquatic garment so that the light will signal the presence in the water of the wearer of the garment.

BRIEF SUMMARY OF THE INVENTION

The invention includes a timing circuit which determines a timed interval and controls the connection between the battery and the light during the timed interval. The timing circuit may be selected and designed to cause the light to flash ON and OFF in a predetermined sequence during the timed interval. The circuit can also be designed so that the light is continuously ON for a period during the timed interval.

Preferably the light, battery and circuit elements, other than water sensing probes and their leads, are encapsulated to avoid water contamination. Two leads connect the encapsulated circuitry to the sensing probes as hereinafter described.

Means are provided for permanently attaching the light and control circuit, preferably at a location where the light is exteriorly visible over a wide range. Preferably the water sensing probes are located on the aquatic garment to be submerged when the garment is worn in normal attitudes of the wearer.

The light and control circuit are permanently attached to the garment.

By "permanently attached" in the disclosure and claims I mean, so attached that the light and control circuit may not be detached without damage to themselves or the garment.

Any light may be used but I find that a light emitting diode ('LED') is the brightest and most efficient. Where a light (LED or otherwise) is referred to herein a plurality of lights or LED's respectively may be used. Where a preferred or specific position or mounting is given for a light, one of a plurality may be in the preferred or specific position or mounting and the remainder elsewhere.

The preferred arrangement of the light, circuitry and probes has the light and all circuit elements, but the probes and the leads thereto encapsulated, with the light located and oriented on the garment to be normally above the water level when said garment is worn by the wearer in the water. The water sensing probes are preferably located to be immersed in water in normal attitude when the garment is worn.

The preferred means of permanently attaching the light and control circuit members is to respectively pair such members with backing plates. One of the member and its backing plate is provided with a barb, the other with a socket which will receive the barb but not release it. Thus the member and the backing plate are permanently attached by pressing the barb through the garment fabric into the counterpart member's socket. It is then permanently attached.

By 'barb' I include, in addition to those of conventional design, a cone or other projection having a free end shaped to penetrate fabric of the garment, and to widen away from the free end to provide a surface or surfaces facing away from the penetration end to resist the withdrawal of the Alternative means of 'permanent attachment' includes stitching or stapling or both.

BRIEF DESCRIPTION OF THE SEVERAL VIEWS OF THE DRAWING

FIG. 1 shows the physical arrangement of the invention.

DETAILED DESCRIPTION OF THE INVENTION

Figure 1:
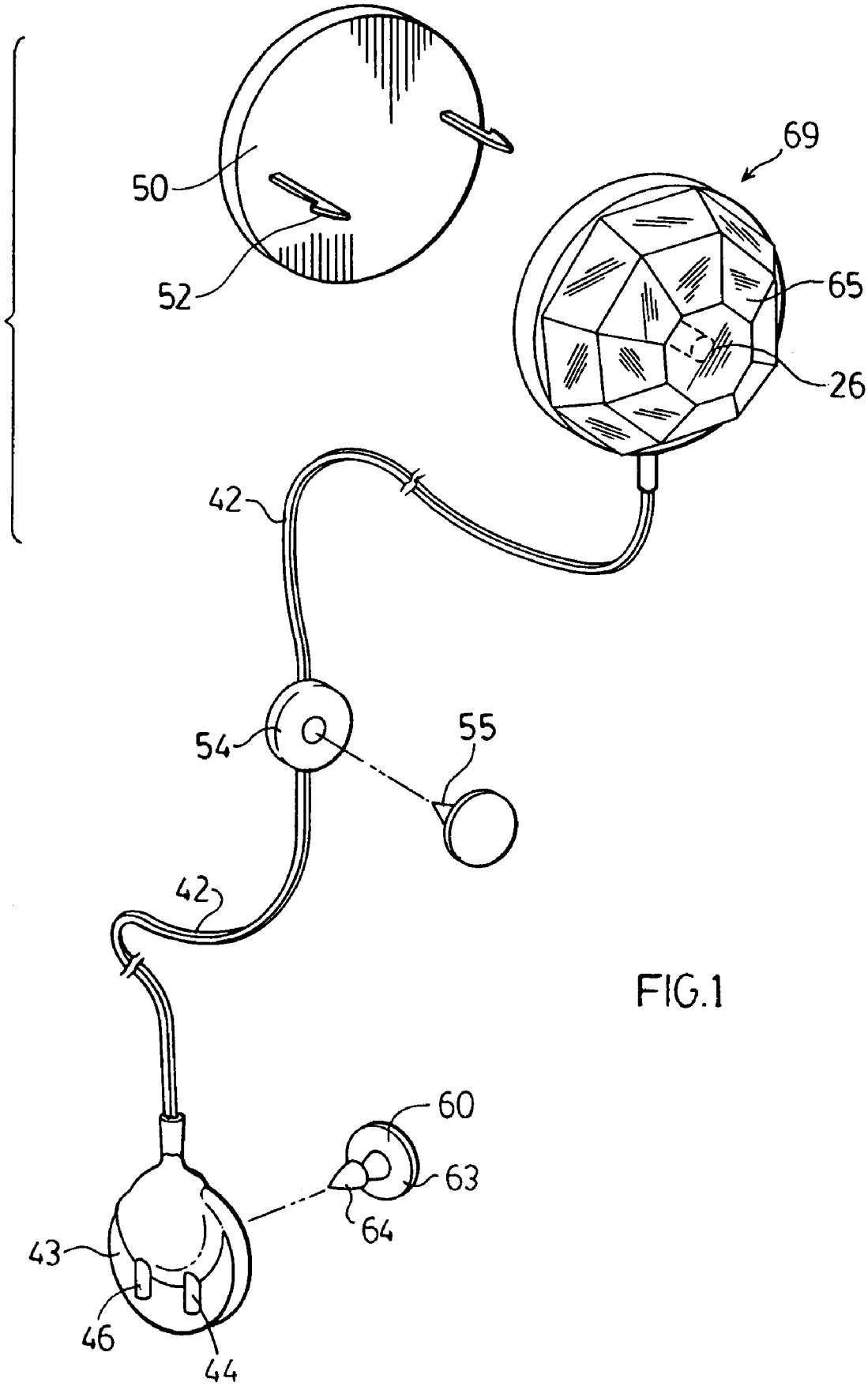
FIG. 1 shows a light and control circuit for application to a life jacket.

An aquatic garment 11 is shown. The light 26, in a protective lens 65, control circuit 67 (excluding the probes and fastener 54) and battery 12 are encapsulated as a body 69 and attached to the shoulder near the top. The body 69 is, with backing member 50, fastened to the garment, where the barbs 52 projecting from backing member 50 are received in sockets in the unit 69 designed to permanently retain barbs 50. The preferred top of shoulder location for the light 26 (see FIG. 3) makes it visible over a wide angle.

The leads 42 preferably extend forwardly from the encapsulated body 69 and down the inside of the garment and are preferably anchored in place at a stabilizing fastener 54 fastened by a probe projecting from backing member 56 comprising a barb 55 passing through garment 11 into a socket (not shown) in fastener 54. The leads 42 continue from fastener 54 downward to a position at the bottom of the garment extending into the backing plate 43 which mounts the water sensing probes 44 and 46. The probes are two narrowly spaced and are each connected to a different one of the leads 42 and exposed for contact with the ambient water.

The backing plate 43 which forms a mounting for the water sensing probes is permanently fastened in place on the jacket fabric, preferably by the provision of socket 62 which receives the outer ends of barb point 64 extending through the garment fabric from backing member 63.

Each set of barbed points and their sockets require a small degree of resilience to achieve their fastening action. We prefer to make material defining sockets and backing plates out of moldable plastic. We prefer to use Polyvinyl Chloride (PVC) or an acrilonitrile-butadiene-styrene (ABS) copolymer but most moldable plastics will do. Members 54 and 55, 62 and 64 may be made of metal which may be stronger and more durable. Members 62 and 64, if metal, must of course be insulated from the probes 44 and 46.

Figures 4, 5:
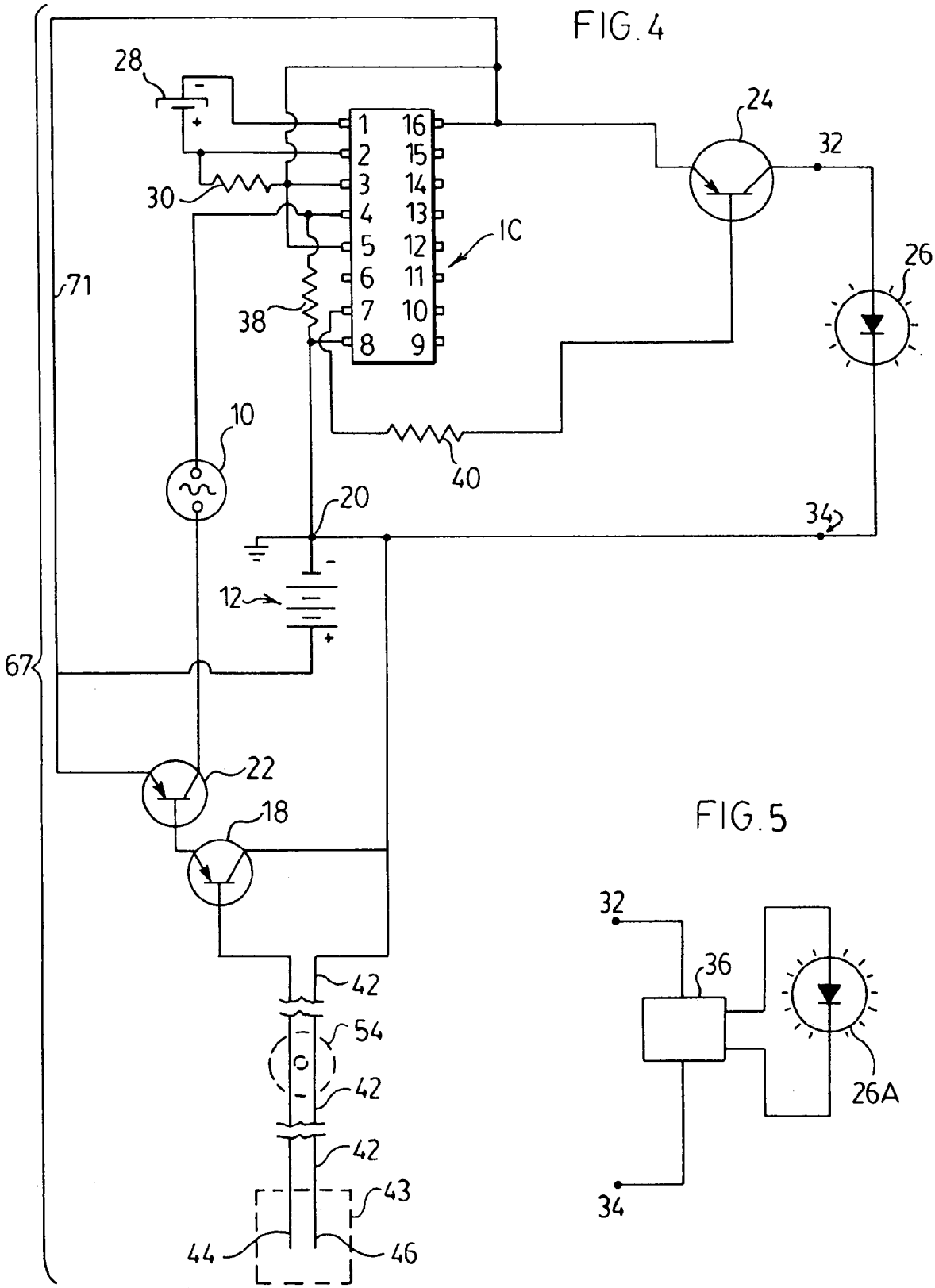
FIG. 4 shows the preferred control circuit.
FIG. 5 shows a modification for the circuit of FIG. 4.

The main unit 67 preferably contains, encapsulated: the light 26, covered by a protective lens 65 and the integrated circuit and the circuit elements shown in FIG. 4.

In the circuit 67 the circuit elements are not shown in detail in FIG. 4, but merely schematically. The body 69 is arranged to hold an LED 26 embedded in a lens of transparent plastic 65. Preferably the inside surface of the transparent plastic is provided with reflecting backing (not shown) to reflect the light from the LED and the outer surface of the transparent plastic is shaped to deflect and cause the light to radiate over a wide angle about the LED. The battery, circuit elements and connections therefore as shown in the schematic, are located beneath the LED, and are all protected by the encapsulation except the two leads 42 which go to the spaced probes 44 and 46 making up the water switch, and the spaced probes.

Figure 3:
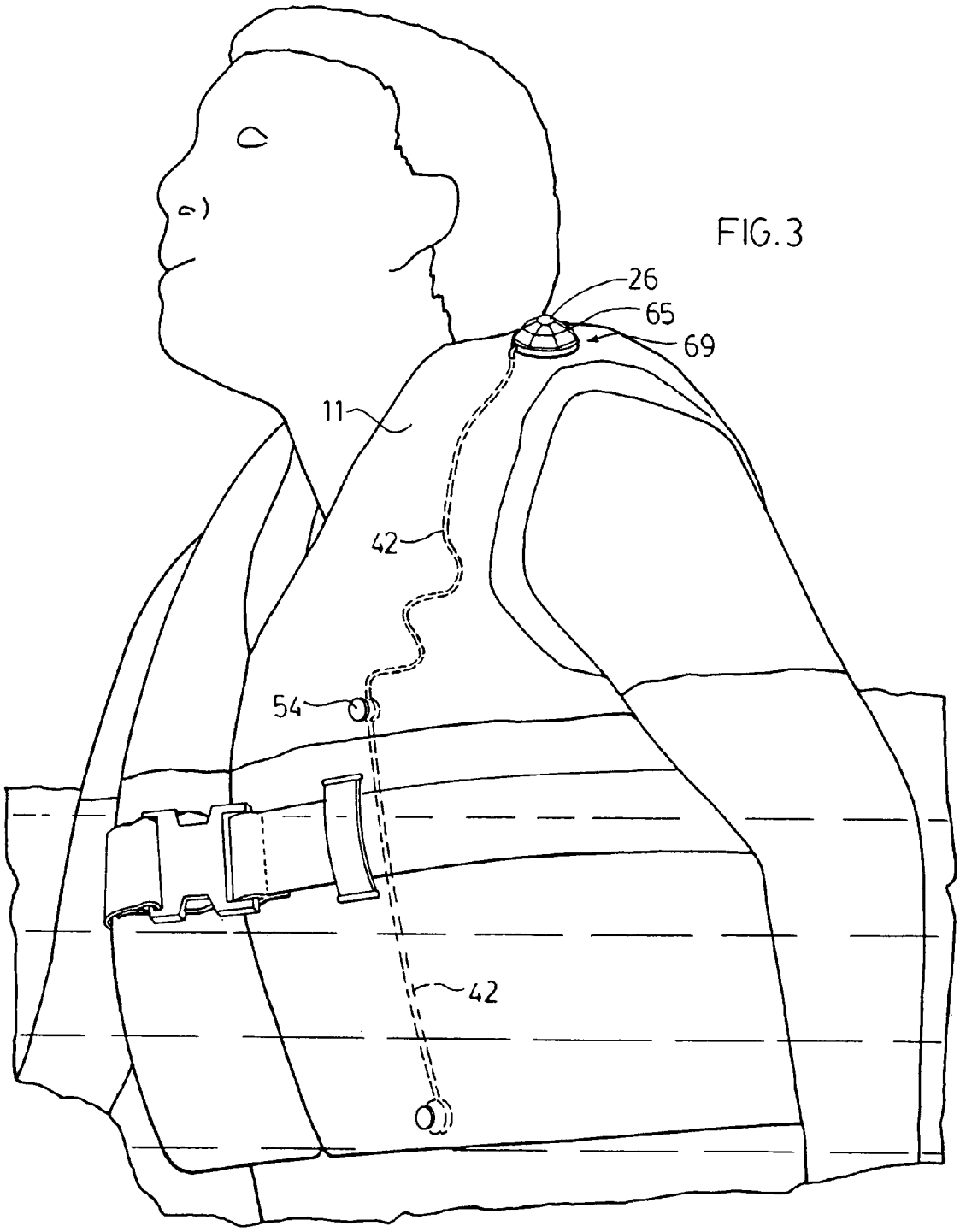
FIG. 3 shows the light and control circuit as attached to the life jacket.

In an alternative arrangement to FIG. 3, (alternative not shown) with the light again affixed to the shoulder and upwardly facing, leads 42 are led inside the jacket and down the inside and rear (not shown) of the garment to a probe location normally below the water level when the jacket is worn. This is, in some alternatives the best mode of using the invention.

In the circuit of FIG. 4 the battery 12 is connected to actuate the timing circuit IC at the latter's terminal 4. To this end the positive terminal of battery 12 (usually 3 volts) is connected through the emitter-collector circuit of PNP transistor 22, and acceleration switch 10 to IC terminal 4. Acceleration switch 10 may be a mercury switch, ball and cylinder switch or other acceleration switch. I prefer to use a spring switch such as one of those shown in U.S. Pat. No. 5,408,764 to WUT Siu B. or U.S. Pat. No. 5,599,088 to CHIEN Tseng L.

Acceleration switches as referred to herein are understood to change state responsive to one of either positive or negative acceleration.

The water switch comprises a gap between probes 44 and 46. When probes 44 and 46 are in the water the water conducts between the probes and lowers the base of PNP transistor 18 to that of instrument ground 20. Emitter-collector conduction in transistor 18 lowers the base of transistor 22 and thus conduction takes place through the emitter-collector of 22 from the positive of battery 12 to the acceleration switch 10. If the acceleration switch closes, when battery 12 is connected thereto, terminal 4 of the integrated circuit IC is caused to go positive, the resultant voltage change from 0–3 volts or binary 0–1 change at terminal 4, creates SET condition in the integrated circuit which causes pin 7 to go negative. This transition creates conduction in the emitter-collector circuit of transistor 24 which connects battery positive on line 71 to LED 26 to illuminate it. After a timed interval determined by the time constant of capacitor 28 and resistor 30 the integrated circuit is returned to RESET condition so that terminal 7 returns to a positive condition and stops conduction in transistor 24 and thus turns off the LED 26. The LED will remain off until there is a new negative to positive transition at terminal 4.

Any other acceleration switch may be substituted for switch 10. A mercury switch may be used although some people consider them environmentally hazardous. Preferred is the spring switch referred to earlier. It is noted that if the acceleration switch 10 should happen to be closed when the probes 44 and 46 are thrust in water, terminal 4 will go positive and initiate a timing cycle in the integrated circuit and turn on the LED for the requisite time interval. Thus conduction in switch 10 during conduction between probes 44 and 46 will initiate the timed interval in accord with IC operation. A timed interval in progress will not be affected by a positive transition at IC terminal 4.

If desired the simple LED 26 connected across the terminals 32–34 may be replaced with an integrated circuit 36 with an LED 26A connected across circuit 36's output at terminals 32 and 34 as shown in FIG. 5. Thus the integrated circuit 36 may be programmed to produce a patterned flashing during the timed interval in accord with the program in the circuit.

Resistors 38 and 40 are part of the means for operating the circuit and are well known to those skilled in the art.

Preferred values for the circuitry of FIG. 4 are as follows:

IC—INTEGRATED CIRCUIT #RR8503 MC 14528
24—TRANSISTOR #2N3906
18—TRANSISTOR #2N3906
22—TRANSISTOR #2N3906
28—CAPACITOR 0.47 uF at 30V
12—BATTERY 3 V
26—LIGHT SOURCE (LED)
10—SWITCH (SPRING)
30—RESISTOR 1 MEGOHM ⅛ w
38—RESISTOR 1 MEGOHM ⅛ w
40—RESISTOR 1 MEGOHM ⅛ w

The acceleration switch may be mercury, if there are no environmental objections. Another motion responsive switch may be used if desired—such as a reed switch as shown in U.S. Pat. No. 5,422,628 or a roller switch as shown in U.S. Pat. No. 5,622,422 or the preferred spring switch previously referred to.

The circuit as shown in FIG. 4 will give a constant light for the duration of conduction in transistor 26 as determined by the RC constants 30 and 28.

Figure 2:
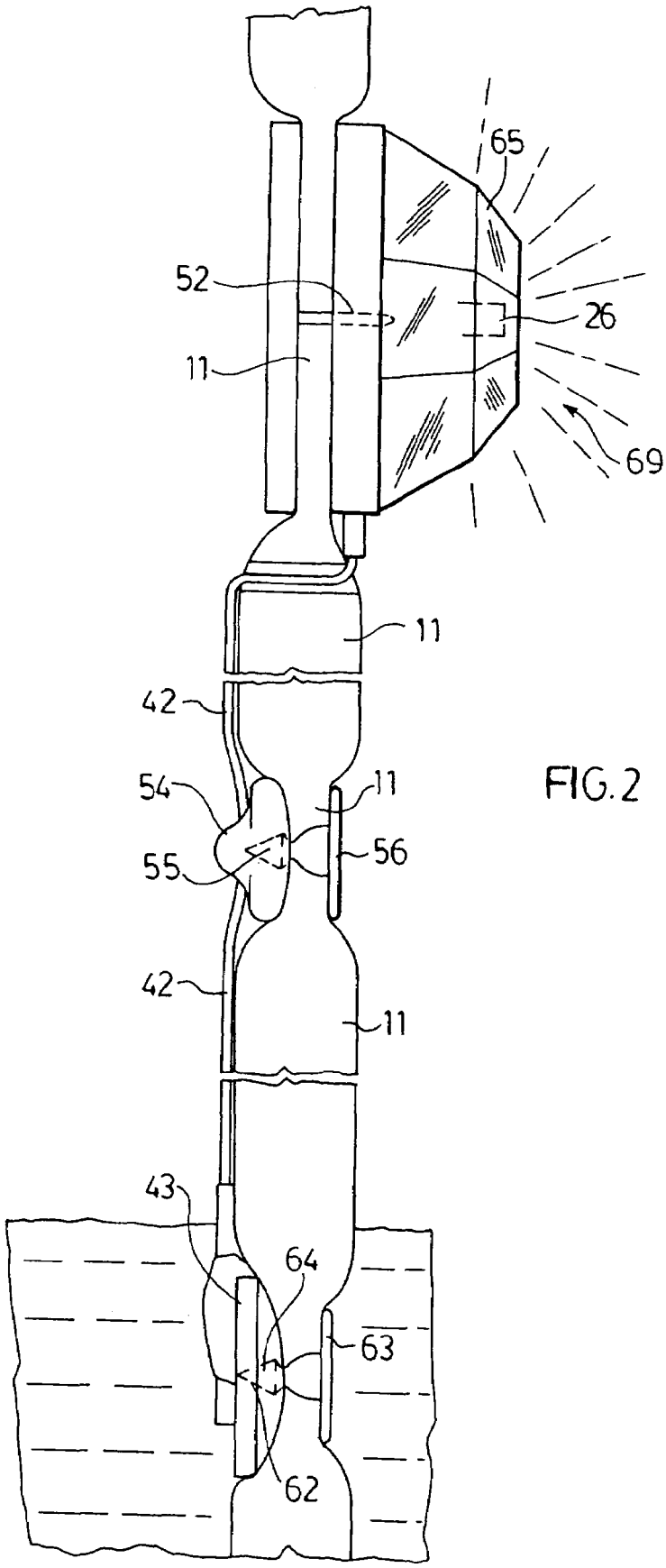
FIG. 2 substantially demonstrates a preferred mode of attachment of the light and control circuit to a life jacket.

However if it is preferred to have a flashing light to a steady light, a suitable circuit such as 36 shown in FIG. 5 may be connected across terminals 32 and 34 instead of the LED 26 of FIG. 2. With chip 36 connected across terminals 32 and 34 the output of chip 36 is connected across LED 26A and causes the LED 26A to flash in accord with the chip programming for the illumination interval, that here coincides with the duration of conduction in transistor 24.

Either LED 26 or 26A may be replaced by two or more LED's. Multiple LED's may be switched on and off and display a pattern or patterns determined by the chip.

The chip 36 is preferably a dedicated chip and may be obtained from Hua Ko Electronics Co. Ltd., 9 Dai Shen Street, Tai Po Industrial Estate, Tai Po N.T., Hong Kong.

The light does not have to be an LED although LED's are believed to be the most efficient and long lasting and operate well on the 3 volt power source proposed. A larger battery or multiple batteries may be used if needed to power up the light source or for longer life.

In the circuit shown in FIG. 4 the timed interval is normally initiated by the closing of the acceleration switch. However it is equally possible, with the invention to use a circuit where the timed interval starts with the opening of an acceleration switch.

The latter mode of operation is well known and an example is shown in U.S. Pat. No. 5,903,103 to M. C. Garner. In Garner the circuit for detecting the opening of the acceleration switch can be in the form of a resistor-capacitor circuit differentiation which produces spikes of voltage whose polarity depends on whether the switch is being opened or closed. A peak detector then senses the polarity of the signal from the differentiation and triggers the light or intermittent or sequential flashing circuit and, in the example given, when the signal indicates switch opening. With a circuit which is triggered by acceleration switch opening, as in the circuit of Garner, the water switch probes and the associated circuitry and transistors may not be in series with the acceleration switch because if the probes were in the water, taking the probes out of the water might be mistaken by the circuit for the opening of the acceleration switch. Thus, with a circuit which triggers the illumination on switch opening, the probes and associated transistors and circuitry must control the light from another location, a choice available to those skilled in the art. With the latter mode of operation, the probes are however located to be normally in the water when the garment is worn; and connected to prevent illumination when out of the water.

Other circuits for timing an interval responsive to an acceleration switch change of state may be used instead of the circuit of FIG. 4. Such circuits preferably will ignore a change of state occurring during an interval in progress.

With the garment worn by the wearer in the water, his presence is evidenced by the light which should flash under ordinary wave motion even if the wearer is otherwise still or unconscious.

In another application of the invention, a group of swimmers equipped with some form of the invention may have lights of different colors so that they may be identified from a distance. As well as different colors the lights of a group of swimmers could be individually programmed to flash different signals, i.e. a long and a short flash for one and a short and two long flashes for another, and so on.

It will be noted that the encapsulated light and battery is worn by a person who is under the water the light will flash showing the location of the swimmer to anyone searching for him.

If desired the method of attaching the unit and water switch to the aquatic garment by barbed members may be replaced with other means of permanent attachment which may include sewing and stapling.

The circuitry operated by the water switch may be adjusted to take into account changes from fresh to salt water.

I claim:

1. A circuit for attachment to an aquatic garment comprising a light, a battery, at least one water-sensing probe, an acceleration responsive switch having an open and closed states timing means, said circuit being permanently attached to an aquatic garment with said light being exteriorly visible, and where said probes are attached to a part of the aquatic garment that is normally immersed in water when the aquatic garment is worn in water, means responsive to a change of state of the switch when there is water sensed by said at least one water-sensing probe to initiate operation of said timing means.

2. The circuit as claimed in claim 1, wherein said light is located on said aquatic garment so as to be visible above the surface of the water when said aquatic garment is in the normal attitude of a wearer in the water.

3. The circuit as claimed in claim 1, wherein said light, battery and acceleration responsive switch are encapsulated.

4. The circuit as claimed in claim 1, wherein said light is an LED.

5. The circuit as claimed in claim 1, wherein the circuit is permanently attached to said aquatic garment by means of a backing member comprising barbs adapted to be received in sockets in said encapsulating body, said sockets being adapted to permanently retain said barbs.

6. An aquatic garment comprising an upper shoulder portion, a light for mounting upwardly facing and on the outside of said upper shoulder portion, a battery for energizing said light, a timing circuit for controlling the energization of said light, an acceleration responsive switch, said timing circuit being responsive to a change of state of said switch to time an interval, means encapsulating said light, battery, switch and timing circuit, and means for attaching said encapsulated elements permanently to said aquatic garment.

7. The aquatic garment as claimed in claim 6, having at least one water-sensing probe operable to initiate operation of said circuit if said probe is immersed in water.

8. The aquatic garment claimed in claim 6, wherein said light is an LED.

9. The circuit as claimed in claim 7, wherein said probe is mounted to be below water level in the normal attitude of a wearer in the water.

10. The aquatic garment as claimed in claim 6, wherein said means for attaching said encapsulated elements permanently to said upper shoulder portion of said aquatic garment includes a backing member having barbs adapted to be received in sockets in said encapsulating body, said sockets being adapted to permanently retain said barbs.

11. A safety light apparatus for an aquatic garment comprising:

a light source;

a battery;

a circuit having a timing means for timing an interval during which the light source is activated;

an acceleration responsive switch being responsive to movement of said aquatic garment to perform transitions between disconnected and connected states where the acceleration responsive switch respectively disconnects and connects said battery to said circuit; and at least one water-sensing probe;

wherein the circuit, the acceleration responsive switch and the water-sensing probe are linked together such that:

(a) when the water-sensing probe is immersed in water and the acceleration responsive switch makes the transition from disconnected to connected states, the circuit is operable to connect said battery and said light source thereby causing said light source to activate; and (b) after the duration of the interval the circuit is operable to disconnect said battery and said light source thereby causing said light source to deactivate.

12. The safety light apparatus as claimed in claim 11, wherein said light source, said battery, said circuit and said acceleration responsive switch are permanently attached to said aquatic garment.

13. The safety light apparatus as claimed in claim 12, wherein said aquatic garment defines a shoulder portion, and wherein said light source is located on said shoulder portion such that the light source is visible above the level of the water and behind and in front of a wearer of said aquatic garment at a normal attitude.

14. The safety light apparatus as claimed in claim 11, wherein said water-sensing probe is permanently attached to said aquatic garment and is connected to said circuit by at least one lead that is permanently attached to said aquatic garment by at least one stabilizing fastener, wherein said lead is disposed substantially internally within said aquatic garment.

15. The safety light apparatus as claimed in claim 14, wherein said aquatic garment defines a bottom portion, and wherein said water-sensing probe is located on said bottom portion such that said water-sensing probe is below the level of the water when said aquatic garment is worn by a wearer in the water at a normal attitude.

16. The safety light apparatus as claimed in claim 11, wherein said light source, said battery, said circuit and said acceleration responsive switch are encapsulated in an enclosure that is substantially impervious to water.

17. The safety light apparatus as claimed in claim 11, wherein said light source is an LED.

18. The safety light apparatus as claimed in claim 16, wherein said enclosure is permanently attached to said aquatic garment by means of a backing member including barbs adapted to be received in sockets in said encapsulating body, said sockets adapted to permanently retain said barbs.

19. The safety light apparatus as claimed in claim 17, wherein said enclosure is permanently attached to said aquatic garment by means of a backing member comprising barbs adapted to be received in sockets in said encapsulating body, said sockets adapted to permanently retain said barbs.

20. A safety light apparatus for an aquatic garment comprising:

an enclosure containing a light source, a battery, a timing circuit and an acceleration responsive switch;

at least one water-sensing probe; and leads leads located internally within said aquatic garment and attached by at least one stabilizing fastener;

wherein said enclosure is located on a shoulder portion of said aquatic garment and permanently attached therein;

wherein said probes are located on a bottom portion of said aquatic garment and permanently attached therein and connected to said enclosure by said leads; and wherein said light source, said battery, said timing circuit, said acceleration responsive switch and said probes are linked together such that:

(a) when the probes are immersed in water and the acceleration responsive switch is closed, the timing circuit connects said battery and said light source thereby causing said light source to activate for a pre-determined interval; and (b) after the duration of the interval, the circuit disconnects said battery and said light source thereby causing said light source to deactivate.

21. A safety life vest comprising a light, a motion-responsive switch, a timing circuit, a battery and two spaced apart water-sensing probes exposed for contact with water, wherein said light, said motion-responsive switch, said circuit and said battery are encapsulated in an enclosure and permanently attached on an upward location on the vest, wherein said probes are permanently attached on a downward location on the vest and connected to said enclosure by leads, and said leads are disposed internally within the said life vest, wherein said motion-responsive switch and said timing circuit are operable when said probes are immersed in water to connect said battery and said light so that in response to motion said light turns on for a timed interval.

* * * * *